US005539999A

United States Patent [19]

Kuhasalo

[11] Patent Number: 5,539,999

[45] Date of Patent: Jul. 30, 1996

[54] DRYER SECTION OF A PAPER MACHINE WITH SELECTED DIAMETER DRYING CYLINDERS AT SELECTED DISTANCES APART

[75] Inventor: Antti Kuhasalo, Jyväskylä, Finland

[73] Assignee: Valmet Corporation, Helsinki, Finland

[21] Appl. No.: 394,639

[22] Filed: Feb. 27, 1995

[30] Foreign Application Priority Data

Mar. 2, 1994 [FI] Finland ..... 940992

[51] Int. Cl.[6] ..... F26B 13/08; D21F 5/04

[52] U.S. Cl. ..... 34/455; 34/120; 34/117; 34/454

[58] Field of Search ..... 34/111–12, 114–17, 34/123, 454, 456, 458; 162/207, 358.5

[56] References Cited

U.S. PATENT DOCUMENTS

| | | | |
|---|---|---|---|
| 4,850,121 | 7/1989 | Ely | 34/116 |
| 4,882,855 | 11/1989 | Loser et al. | 34/116 |
| 5,022,163 | 6/1991 | Ilvespaa et al. | 34/23 |
| 5,279,050 | 1/1994 | Tormanen | 34/117 |

FOREIGN PATENT DOCUMENTS

| | | | |
|---|---|---|---|
| 83246 | 10/1987 | Finland . | |
| 913648 | 2/1993 | Finland . | |
| 92297 | 1/1896 | Germany | 34/116 |
| 3910612 | 10/1992 | Germany . | |

*Primary Examiner*—John M. Solleoito
*Assistant Examiner*—Steve Gravini
*Attorney, Agent, or Firm*—Steinberg, Raskin & Davidson, P.C.

[57] ABSTRACT

A group with single-wire draw in a dryer section of a paper machine having heated smooth-faced drying cylinders against whose smooth face a paper web to be dried is brought into direct contact, and reversing cylinders. The group with single-wire draw also includes a drying wire which is guided in a loop by guide rolls as well as by the drying cylinders and reversing cylinders so that the drying cylinders are placed outside the wire loop and the reversing cylinders are situated in gaps between the drying cylinders inside the loop of the drying wire. In the group with single-wire draw, the drying cylinders include large cylinders and small cylinders, the diameter of the large cylinders is substantially larger than the diameter of the small cylinders. The small cylinders are placed in gaps between the large cylinders so that their centers of rotation are on a level substantially different than the level of the centers of rotation of the large cylinders. The reversing cylinders are arranged on the runs of the drying wire and the web from a large cylinder to a small cylinder and from a small cylinder to a large cylinder, the centers of the reversing cylinders being placed on a level substantially different than the corresponding levels of the large cylinders and the small cylinders.

23 Claims, 4 Drawing Sheets

DRYER SECTION OF A PAPER MACHINE WITH SELECTED DIAMETER DRYING CYLINDERS AT SELECTED DISTANCES APART

BACKGROUND OF THE INVENTION present invention relates to a group with single-wire draw in the dryer section of a paper machine, comprising a number of heated smooth-faced drying cylinders against whose smooth face a paper web to be dried is brought into direct contact, and a number of reversing cylinders, the group with single-wire draw comprises a drying wire which is guided in a loop by guide rolls as well as by the drying cylinders and reversing cylinders such that the drying cylinders are arranged outside the wire loop and the reversing cylinders are arranged in gaps between adjacent pairs of the drying cylinders inside the loop of the drying wire. In the group with single-wire draw, the drying cylinders consist of large-diameter cylinders and small-diameter cylinders, the diameter of the large-diameter cylinders being substantially larger than the diameter of the small-diameter cylinders.

further, the present invention relates to a dryer section of a paper machine exclusively or substantially composed of groups with single-wire draw in accordance with the invention.

The present invention also relates to a method for reducing the length of a dryer section of a paper machine.

In the prior art, in multi-cylinder dryers of paper machines, twin-wire draw and/or single-wire draw is/are employed. In twin-wire draw, the groups of drying cylinders include two wires which press the web, one from above and the other one from below, against the heated cylinder faces. Between the rows of drying cylinders, which are usually horizontal rows, the web has free and unsupported draws which are susceptible to fluttering which may cause web breaks, in particular in the stages of the drying in which the web is still relatively moist and, therefore, of low strength. For this reason, in recent years, increasing use has been made of the single-wire draw cylinder groups, in which each group of drying cylinders has only one drying wire on whose support the web runs through the whole group so that the drying wire presses the web on the drying cylinders against the heated cylinder faces, whereas, on the reversing cylinders or rolls situated between the drying cylinders, the web remains at the side of the outside curve. Thus, in single-wire draw, the drying cylinders are placed outside the wire loop and the reversing cylinders or rolls are situated inside the wire loop.

A dryer section that consists of normal groups with single-wire draw alone involves the drawback that the paper web is dried from S the side of its lower face alone, which may cause a tendency of curling in the web. Therefore, it is known from the prior art, for the drying of a paper web to use dryer sections in which there are, for example, alternatingly so-called normal groups and inverted groups with single-wire draw. From the prior art, dryer sections are known that consist exclusively of so-called normal groups with single-wire draw. Also, dryer sections are known in which all the other groups except the last group are normal groups with single-wire draw, whereas the last group is a group with twin-wire draw.

In the dryer sections mentioned above, various problems have occurred, for which problems the present invention suggests novel and efficient solutions. These problems include the large length of the dryer section which increases the costs of the dryer section and the machine hall. Problems have also been encountered in the runnability of the dryer section, in the threading of the web, and those arising from differences in the speeds of different wires, as well as problems related to control of transverse shrinkage of the web. In inverted drying groups, in the event of breaks, a problem consists of the removal of broke, for inverted groups are not self-cleaning by the force of gravity. Generally, these problems tend to become worse as the running speed of the paper machine becomes higher.

Since, in the prior art dryer-section constructions, the overall length of the dryer section is considerably large, this increases the cost of investment of a paper mill, above all the construction cost. If it were possible to reduce the length of the dryer section, it would also be possible to reduce the construction cost required by the paper mill in the same proportion.

OBJECTS AND SUMMARY OF THE INVENTION

It is an object of the present invention to provide a novel dryer section that can also be applied to modernizations of paper machines, so that the drying capacity can be increased, for example, in connection with an increase in the running speed of the paper machine or in connection with a change of the paper grade to be produced. It is a typical example of a change of paper grade that a surface-sizing device is situated at the final end of the dryer section, together with the finishing-dryer necessary thereafter. Thus, it is another object of the invention to provide a novel dryer section that is suitable for this purpose and by whose means the dryer section placed before the surface-sizing device can be made shorter while maintaining the drying capacity, so that the surface-sizing device and the finishing-dryer can be arranged after the shorter dryer section in the place of the previous dryer section before the machine reel-up, which must generally be allowed to stay in its previous location.

Still another object of the present invention is to provide a novel dryer section for a paper machine which is considerably shorter than the prior art dryer sections that have an equivalent drying capacity and number of cylinders.

Regarding the prior art related to the present invention, reference is made to Finnish Patent No. 83,246 (in the name of Beloit Corporation and corresponding to U.S. Pat. No. 4,850,121), to DE Patent 3,910,612, in the name of J. M. Voith GmbH, as well as to the assignee's Finnish Patent Application No. 913648 (corresponding to the assignee's U.S. Pat. No. 5,279,050, the specification of which is hereby incorporated by reference herein).

Of the prior art cited above, the '050 patent is most closely related to the present invention. However, an underlying object of the present invention is further development of the geometry and the grouping of the cylinders in a group with single-wire draw as described in the '050 patent. In the '050 patent, drying cylinders of two different diameters and reversing cylinders of two different diameters are used, of which cylinders the drying cylinders with larger diameter are placed in the uppermost horizontal level, and the reversing cylinders placed in the gaps between every other pair of upper drying cylinders and the drying cylinders of smaller diameter placed in the gaps between every other pair of cylinders are placed in the next, lower horizontal level. The last-mentioned reversing cylinders and drying cylinders have substantially equal diameters. In the lowest, third level, the reversing cylinders of smaller diameter are placed, which are preferably placed in pairs at both sides of the gap between every other pair of upper drying cylinders, a drying cylinder of smaller diameter being placed above, and in the middle of, the gap between each pair of lower reversing cylinders. Drawbacks of the drying group of the '050 patent include that the drying cylinders and the reversing cylinders are placed at quite a large difference in height in relation to one another, so that servicing of the machine from one tending platform is difficult, and that, for the machine, both drying cylinders of two different diameters and reversing cylinders of two different diameters are needed, which increases the costs of manufacture and spare parts of the dryer section.

It is yet another object of the present invention to eliminate the drawbacks described above while, nevertheless, retaining the objectives aimed at in the '050 patent, i.e. to provide a dryer section of substantially shorter length, in which dryer section the drying capacity is however retained and a draw optimal in view of the operability of the dryer section is obtained for the web.

It is a further object of the invention to provide a dryer section that can be tended from one tending platform, which is a substantial advantage in comparison with the dryer sections of the '050 patent and with the prior art so-called vertical dryer sections. In the invention, these objects are achieved without undue increase in the costs of manufacture and spare parts of the dryer section.

In view of achieving the objects stated above and others, in the group with single-wire draw in accordance with the invention, small cylinders, i.e., cylinders having a smaller diameter than "large-diameter cylinders" are placed in gaps between adjacent pairs of the large-diameter cylinders or simply large cylinders so that their centers of rotation are on a level substantially different than the level of the centers of rotation of the large cylinders, and reversing cylinders are arranged on the runs of the drying wire and the web both from a large cylinder to a small cylinder and from a small cylinder to a large cylinder. The centers of the reversing cylinders are placed on a level substantially different than the corresponding levels of the large cylinders and the small cylinders. Moreover, each of the small-diameter cylinders, the large-diameter cylinders and the reversing cylinders are spaced from a successively arranged small-diameter cylinder, large-diameter cylinder or reversing cylinder a distance which is less than the diameter of the large-diameter cylinder. In other words, the shortest distance between the cylinder faces of adjacent small-diameter cylinders is less than the diameter of the large-diameter cylinder, the distance between cylinder faces of adjacent large-diameter cylinders is less than the diameter of the large-diameter cylinder and the distance between cylinder faces of adjacent reversing cylinders is less than the diameter of the large-diameter cylinder. Preferably, the distance is approximately one-half of the sum of the diameter of the large-diameter cylinders and the diameter of the small-diameter cylinders.

In a dryer section composed of drying groups in accordance with the invention, all or most of the groups with single-wire draw in the dryer section are such groups as described above which constitute normal groups, i.e., dryer groups in which the large cylinders are placed on the highest level, the small cylinders on the middle level, and the reversing cylinders on the lowest level, and that the web has a closed draw in all or most of the group gaps between the normal groups. The dryer section may also comprise inverted groups in accordance with the invention, i.e., dryer groups in which the large cylinders are placed on the lowest level, the small cylinders on the middle level, and the reversing cylinders on the highest level, or even groups with twin-wire draw in selected positions.

In a dryer section in accordance with the present invention, the hot coverage on the drying cylinders within a certain length in the machine direction can be made larger than in the prior art, by means of which the overall length of the dryer section can be made shorter. According to preliminary estimates, by means of a dryer section in accordance with the present invention, compared with the SYM-RUN™ concept applied by the assignee, the length of the dryer section can be shortened by about 10% to about 15% because the hot coverage length of the paper web per unit of length of the dryer section is substantially longer in a dryer section in accordance with the invention. This is a valuable advantage because the cost of investment of a new paper machine hall can be reduced substantially. Also, in modernizations of paper machines, the drying capacity can be increased with the existing length of the dryer section, for example, for increase in the running speed of the paper machine or for change of paper grade. A typical change of paper grade is to provide the dryer section of a paper machine with a surface-sizing device and with a following finishing-dryer, for which space can be arranged owing to the present invention, because the dryer section to be modernized can be made shorter accordingly.

It is another important advantage of the invention that the ease of servicing and the ease of tending of the paper machine remain good and efficient because the tending platform can be maintained as one single platform, which is not the case when so-called vertical dryers are used. Moreover, the runnability of the dryer section in accordance with the invention remains favorable because a mode of transfer of the web is employed that is substantially equivalent to a conventional single-wire draw as provided with suction cylinders or suction rolls.

It is a further advantage of a dryer section in accordance with the invention that ropeless tail threading can be applied favorably over its entire length.

In the following, the invention will be described in detail with reference to the figures in the accompanying drawing, in which some preferred exemplifying embodiments of the invention are illustrated. However, the invention is not strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
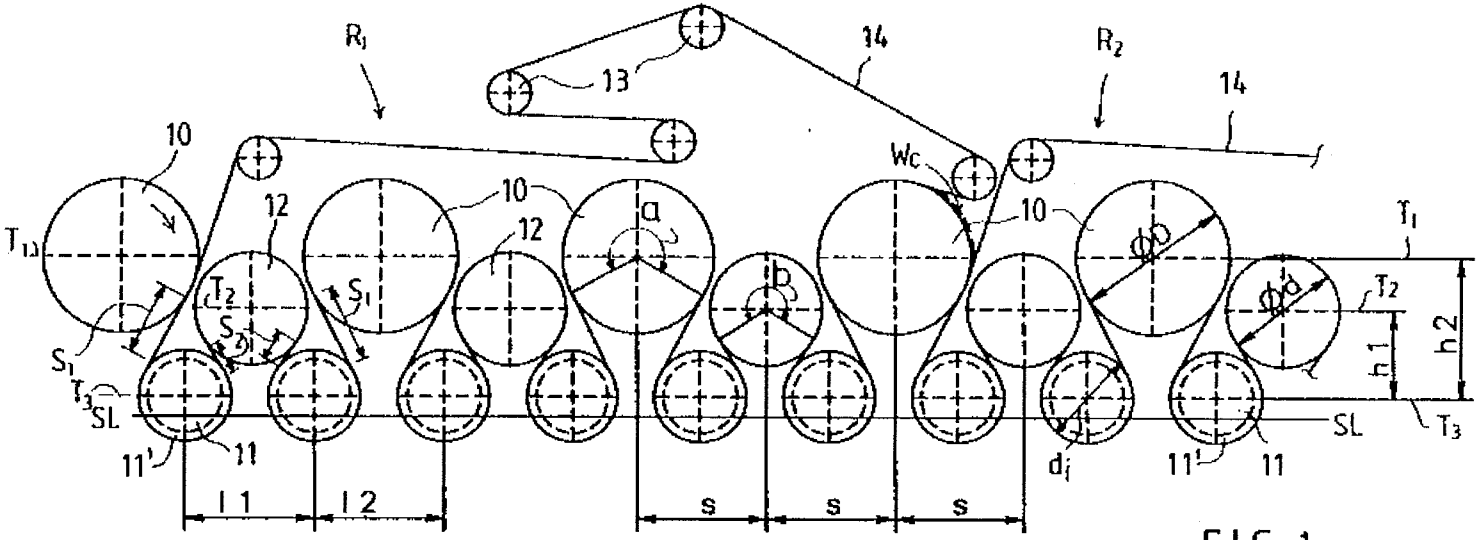
FIG. 1 is a schematic side view of two successive groups with single-wire draw in accordance with the invention without frame constructions.

Referring to the accompanying drawings wherein like reference numerals refer to the same elements, with reference to FIGS. 1–4, the general principles and the common features of the construction of a group with single-wire draw in accordance with the invention will be described. Two successive wire groups $R_1$ and $R_2$ shown in FIGS. 1–4 are in the other respects substantially similar to prior art normal (not inverted) drying groups except that the dryer section includes contact drying cylinders 10,12 of two different diameters D,d, respectively, which cylinders are placed in a very compact alternating arrangement, i.e., one cylinder of diameter D followed by one cylinder of diameter d in a repeating sequence. In the illustration embodiment of a normal drying group in accordance with the invention, the large cylinders 10 of larger diameter D are placed on a highest level $T_1$, and the small cylinders 12 of smaller diameter d are placed on a lower level $T_2$. The difference in height between these levels ($T_1$–$T_2$) is $h_2$–$h_1$, whereby $h_2$ is the height of the centers of the large cylinders from the line representing the tending platform (SL—SL) and $h_1$ is the height of the centers of the small cylinders from the line representing the tending. In the gap between each adjacent pair of the drying cylinders 10,12, on a level $T_3$ substantially lower than the height levels $T_1$ and $T_2$, reversing cylinders 11 having a diameter di are placed. The paper web W to be dried runs through the drying groups $R_1$, $R_2$ on support of drying wires 14 which are guided in part by leading rolls 13 so that, on the reversing cylinders 11, the web W remains at the side of the outside curve, and on the drying cylinders 10,12, the web W is pressed by the drying wire 14 into direct contact against the heated faces of the drying cylinders 10,12. In the invention, the diameters of the large cylinders 10, the small cylinders 12, and of the reversing cylinders 11 are selected such that D>d>di.

By means of the invention, a particularly compact dryer section is accomplished so that, per meter of horizontal length of the dryer section in the machine direction, substantially more "hot coverage" is obtained as compared with the prior art. This is achieved in view of the fact that considerably larger covering sectors a and b are obtained on the drying cylinders 10,12 (FIG. 1). Covering sector a is typically in a range of from about 220° to about 280°, preferably from about 235° to about 265° , and covering sector b is typically in a range of from about 200° to about 260°, preferably from about 210° to about 250° .

On the reversing cylinders 11, the web W is kept reliably on support of the wire 14 against the effects of centrifugal forces by the effect of the negative pressure present in grooved faces 11' of the reversing cylinders 11 whereby transverse shrinkage of the web W is also counteracted. The reversing suction cylinders 11 that are used are preferably suction cylinders marketed by the assignee under the trade mark "VAC-ROLL"™, which cylinders have no inside suction boxes and with respect to the details of whose constructions reference is made to the assignee's FI Patent No. 83,680 (corresponding to the assignee's U.S. Pat. No. 5,022,163, the specification of which is hereby incorporated by reference herein). However, it should be emphasized that the scope of the invention also includes dryer sections in which, in the positions of the reversing cylinders 11, ordinary suction rolls provided with an inside suction box are used, also including suction rolls of quite small diameters. Normal suction rolls are, however, in this connection, not equally favorable as the "VAC-ROLL"™ rolls. In some special cases, as reversing cylinders 11, it is also possible to use other cylinders or rolls besides the suction cylinders or rolls provided with inside vacuum and with perforated mantles, for example rolls provided with solid mantles and grooved faces, marketed by the assignee under the trade mark "UNO-ROLL"™, in whose grooves a slight negative pressure is produced by means of ejection blowers arranged in wedge spaces between the mantles of the rolls and the drying wire. In exceptional cases, even smooth rolls can be used as the reversing cylinders 11 if the speed and runnability of the machine permit.

Figure 2:
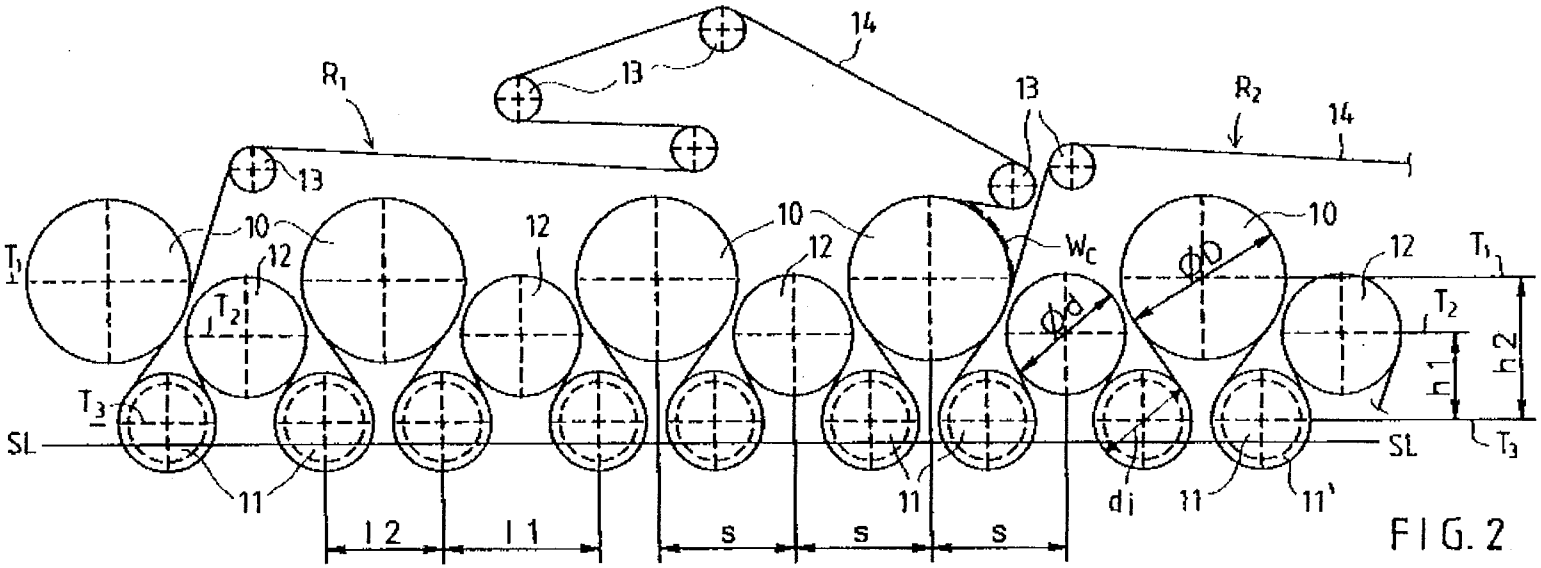
FIG. 2 shows a second variation of the invention similar to FIG. 1.

In the exemplifying embodiment shown in FIG. 1, the first cylinder in each wire group $R_1$, $R_2$ is a small cylinder 12 (smaller diameter d), and the last cylinder is a large cylinder 10 (larger diameter D) on whose free sector the web W is transferred as a closed draw WC onto the wire 14 in the next group and further onto the first reversing cylinder 11. A similar arrangement is illustrated in FIG. 2. FIGS. 1 and 2 differ from one another in the respect that in FIG. 1, the horizontal spacing $l_1$ of the reversing cylinders 11 placed at both sides of the small cylinders 12 is equal to the spacing $l_2$ of the reversing cylinders 11 placed at both sides of the large cylinders 10, i.e. $1_1=1_2$. In contrast thereto, in FIG. 2, $l_1>l_2$ In all of embodiments illustrated in FIGS. 1–4, the horizontal spacing of the large and small cylinders 10,12 in relation to one another is equal spacing s both within a group and in the group gaps between the groups $R_1$, $R_2$, in which preferably a closed draw WC is employed. In the group gap, the spacing may also be different.

Figure 3:
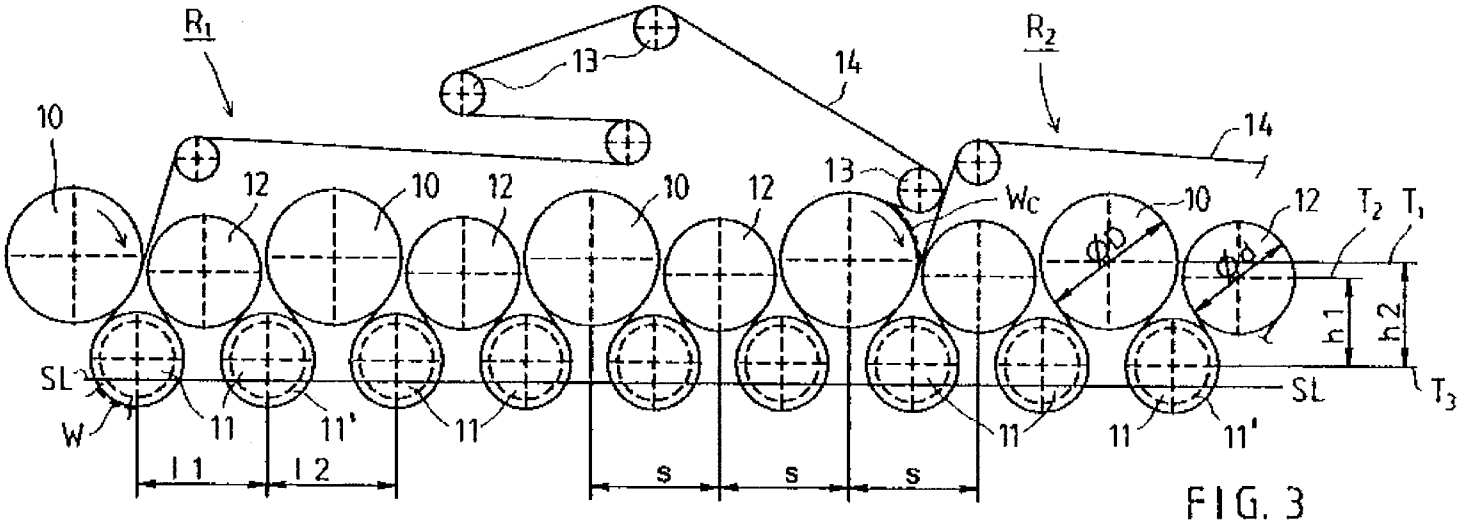
FIG. 3 shows a third variation of the invention similar to FIGS. 1 and 2.
Figure 4:
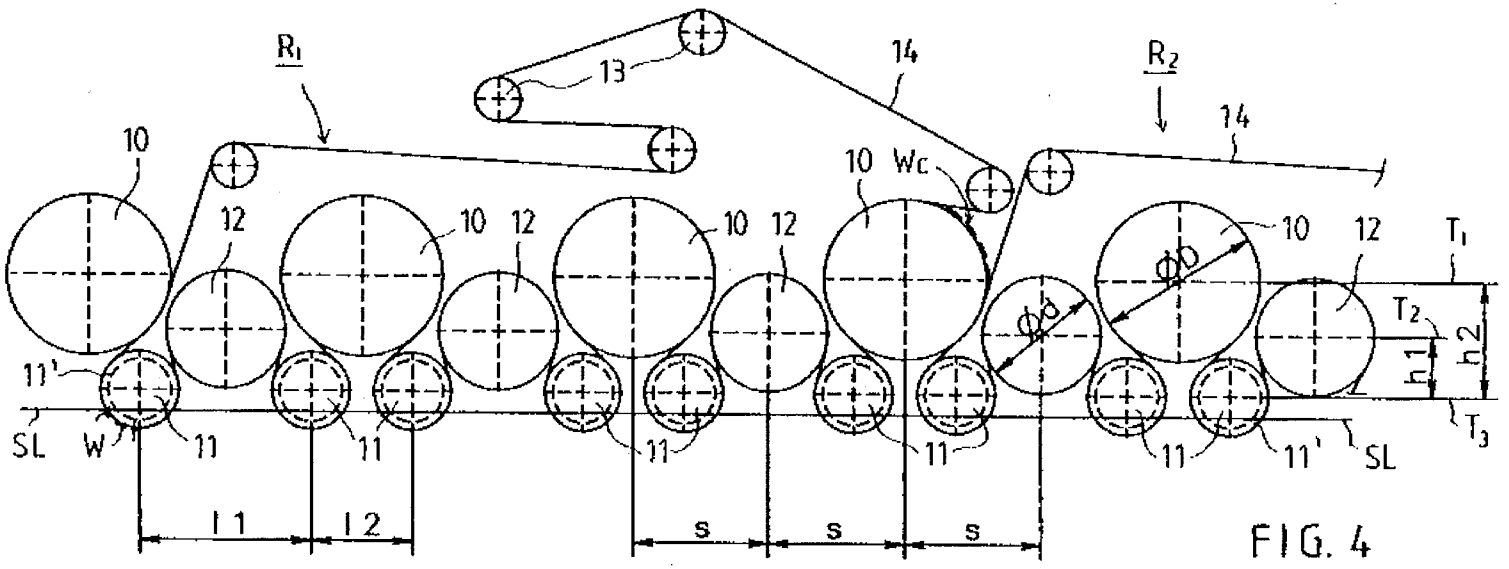
FIG. 4 shows a fourth variation of the invention similar to FIGS. 1, 2 and 3.

The dryer sections illustrated in FIGS. 1, 2 and 4 differ from the wire groups $R_1$, $R_2$ illustrated in FIG. 3 in the respect that, in FIG. 3, the difference in height $h_{2-h1}$ between the levels $T_1$ and $T_2$ of the location of the drying cylinders 10,12 is substantially smaller than in the dryer groups illustrated in the other figures. In FIG. 3, the ratio of the diameters D/d of the drying cylinders 10,12 differs from FIGS. 1, 2 and 4. For this reason, the lengths $s_1 \approx s_2$ of the straight runs of the wire 14 and the web W arriving on the large cylinders 10 can be made substantially shorter. The lengths of these runs $s_1$ and $s_2$ are typically selected in the range of from about 500 mm to about 1500 mm, and usually so that $s_1>s_2$. corresponding aim is achieved in FIG. 4 so that the difference in height $h_1$ between the levels $T_2$ and $T_3$ is arranged shorter than in the dryer groups illustrated in the other figures, and di is smaller than in the dryer groups illustrated in the other figures. Moreover, FIGS. 3 and 4 differ from one another in the same way as FIGS. 1 and 2 differ from one another in the respect that, in FIGS. 1 and 3, the horizontal spacing of the reversing cylinders 11 is equal spacing, $l_1=l_2$, whereas in FIGS. 2 and 4, $l_1>l_2$ .

It is an important feature of the invention that the horizontal spacing s of the large and small cylinders 10,12 is shorter than the diameter of the large cylinder, i.e. s<D. Most appropriately, the mutual proportion of the quantities s and D is selected such that the small and the large cylinders 10,12 could not be arranged on the same level even in theory, i.e. s<(D+d)/2, which improves the ratio of hot coverage to overall length of the dryer section further. As stated above, the reversing cylinders 11 can be arranged either with equal spacing $l_1=l_2=s$ or with variable spacing, in which case $l_1<l_2$ and/or $l_1>l_2$. Then, by selecting $l_1+l_2=2\times s$ with variable spacing, in different geometries it is possible to maximize the drying capacity per meter of length of the dryer section in the machine direction.

In a preferred embodiment of the invention, equal spacing s is used as the spacing between the large and small cylinders 10,12 both inside the cylinder groups $R_1$, $R_2$ . . . and in the group gaps, in whose areas the web W has preferably a closed draw WC.

In the illustrated embodiments, the tending platform of the paper machine is represented by the line SL—SL. From this one single platform, the dryer section can be tended and serviced across its entire length.

In the following, a table will be reproduced, in which nine different examples of dimensioning I . . . IX of the invention are given. Moreover, in view of facilitating a comparison, in the last column the corresponding dimensioning parameters are given concerning a prior art "SYM-RUN"™ single-wire concept employed by the assignee. In the following table, $s_1$ and $s_2$ denote lengths of the straight joint draws of the wire 14 and the web W from the drying cylinders 10,12 to the suction cylinders 11 and vice versa, the draws being indicated in FIG. 1.

| Quantity | I | II | III | IV | V | VI | VII | VIII | IX | SYM-RUN |
|---|---|---|---|---|---|---|---|---|---|---|
| D | 2500 | 2300 | 2200 | 2500 | 2300 | 2200 | 2400 | 2400 | 2500 | 1830 |
| d | 1830 | 1830 | 1830 | 1830 | 1830 | 1830 | 1830 | 1830 | 1830 | 1830 |
| di | 1500 | 1500 | 1500 | 1500 | 1500 | 1500 | 1500 | 1500 | 1500 | 1500 |
| s | 2100 | 2100 | 2100 | 2100 | 2100 | 2100 | 2100 | 2100 | 2100 | 2100 |
| l1 | 2100 | 2100 | 2100 | 2400 | 2400 | 2140 | 2100 | 2400 | 2630 | 2100 |
| l2 | 2100 | 2100 | 2100 | 1800 | 1800 | 2060 | 2100 | 1800 | 1570 | 2100 |
| h1 | 1420 | 1420 | 1420 | 1300 | 1300 | 1410 | 1420 | 1300 | 940 | 1600 |
| h2 | 2270 | 1950 | 1670 | 2150 | 1830 | 1660 | 2120 | 2100 | 1790 | 1600 |
| a | 236.6 | 241.6 | 255.0 | 252.8 | 265.0 | 258.8 | 238.4 | 257.0 | 275.0 | 234.4 |
| b | 248.0 | 248.0 | 248.0 | 235.0 | 235.0 | 246.0 | 248.0 | 235.0 | 210.4 | 234.4 |
| s1 | 1502 | 1138 | 685 | 1197 | 741 | 628 | 1340 | 1004 | 631 | 944 |
| s2 | 589 | 589 | 589 | 598 | 598 | 601 | 589 | 598 | 564 | 994 |

For the measures indicated in FIGS. 1–3, with different dimensioning parameters, suitable and preferred ranges of proportions are, for example:

$l_1$/s=from about 1.0 to about 1.5;

$l_2$/s=from about 0.7 to about 1.0;

$h_1$/s=from about 0.4 to about 0.8;

$h_2$/s=from about 0.7 to about 1.1;

D/di=from about 1.4 to about 3.5;

d/di=from about 1.2 to about 3.0.

In view of the objects of the invention, particularly suitable ranges of measures of the various parameters are, for example:

D≈from about 1800 mm to about 2600 mm, preferably D≈from about 2200 mm to about 2500 mm;

d≈from about 1500 mm to about 2000 mm, preferably d≈from about 1800 mm to about 1900 mm;

di≈from about 600 mm to about 1800 mm, preferably di≈from about 1200 mm to about 1500 mm.

In the following, a preferred example of dimensioning of the wire groups as shown in the different embodiments illustrated in FIGS. 1–4 will be given.

FIG. 1.

Equal horizontal spacing, wherein $s=l_1=l_2\approx 2100$ mm, D=about 2500 mm, d=about 1830 mm, di=about 1500 mm, $h_1$ =about 1420 mm, and $h_2$=about 2270 mm.

FIG. 2.

Embodiment of variable horizontal spacing with diameters of FIG. 1, but s=about 2100 mm, $l_1$=about 2400 mm, $l_2$=about 1800 mm, $h_1$=about 1300 mm, and $h_2$=about 2150 mm.

FIG. 3.

Exemplifying embodiment of equal spacing ($s=l_1=l_2=$ about 2100 mm), wherein D=about 2200 mm, d=about 1830 mm, di=about 1500 mm, $h_1$=about 1420 mm, and $h_2$=about 1670 mm.

FIG. 4.

Embodiment of variable horizontal spacing, wherein D=about 2500 mm, d=about 1830 mm, s=about 2100 mm, $l_1$=about 2630 mm, $l_2$=about 1570 mm, di=about 1200 mm, $h_1$=about 940 mm, and $h_2$=about 1790 mm.

Figure 5:
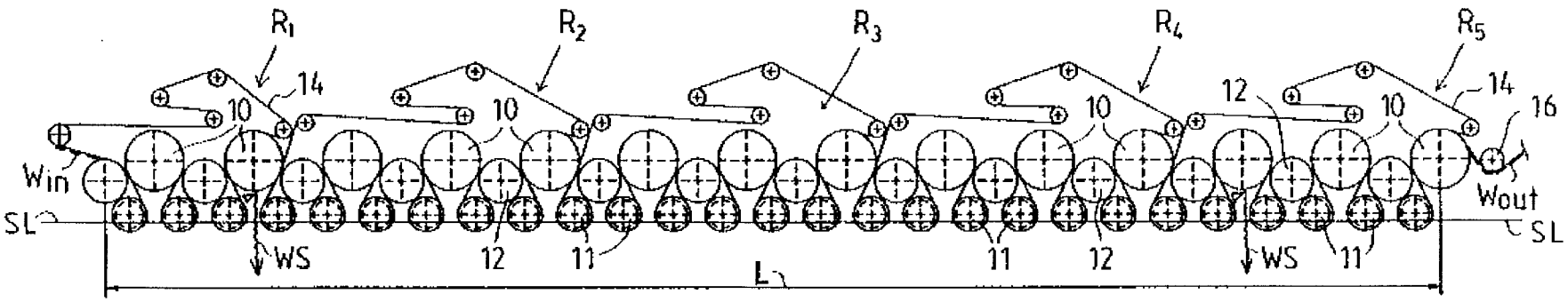
FIG. 5 shows a first exemplifying embodiment of a dryer section comprising groups with single-wire draw in accordance with the invention.

FIGS. 5–8 show preferred exemplifying embodiments from which out of the wire groups $R_1, \ldots, R_n$ in accordance with the invention, it is possible to construct dryer sections whose overall length L is shorter than in prior art dryer sections. In FIG. 5, the dryer section comprises five successive normal (not inverted) groups $R_1$, . . . , $R_5$ with single-wire draw in accordance with the invention. In the groups $R_2$, . . . , $R_5$, there are three large cylinders 10 and three small cylinders 12 and six reversing cylinders 11. In the first group $R_1$, there are just two large cylinders 10 and two small cylinders 12 and three reversing cylinders 11. In FIG. 5, the arrows WS illustrate the removal of paper broke which can take place, in a dryer section of FIG. 5, over its entire length by means of gravity onto the broke conveyor (not shown) placed underneath.

Figure 6:
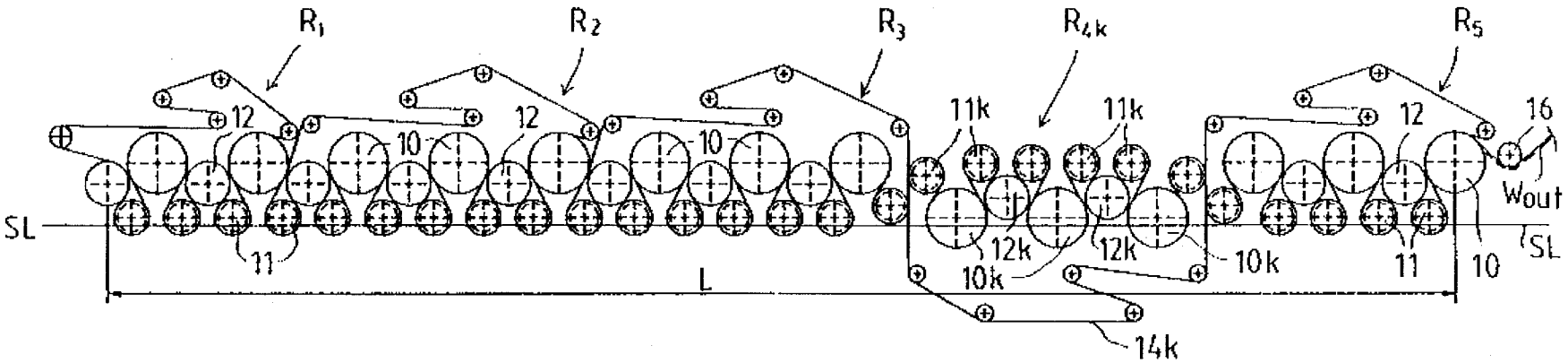
FIG. 6 is an illustration similar to FIG. 5 of a dryer section that comprises groups with single-wire draw in accordance with the invention and in which there is one inverted group in accordance with the invention.

In FIGS. 5 and 6, the web W is passed from the press section (not shown) of the paper machine to the first group $R_1$, which passing is represented by the reference $W_{in}$, and similarly the dried web W is removed while guided by the leading roll 16, which is represented by the reference $W_{out}$.

In FIG. 5, the overall length L of the dryer section is, according to preliminary estimates, about 20% to about 25% shorter than the length of a dryer section of the SYM-RUN™ concept that has an equivalent drying capacity.

FIG. 6 illustrates an embodiment which in the other respects similar to the embodiment shown in FIG. 5, but in which the second-to-last or penultimate (fourth) wire group is an inverted group $R_{4k}$ in accordance with the invention. In the inverted group $R_{4k}$, the lower cylinders consist of three large cylinders **10*k*, the middle cylinders of two small cylinders 12*k*, and the upper cylinders of six reversing cylinders 11*k***, of which the first one and the last one are preferably placed at a slightly lower level than the four middle ones. Between all of the groups $R_1$, $R_2$, $R_3$, $R_{4k}$, and $R_5$, there is closed draw. The inverted group $R_{4k}$, in a way in itself known, contributes to ensuring a sufficiently symmetric drying, i.e. the fact that the web W is dried from both of its sides with an adequate capacity so as to reduce the tendency of curling of the web.

Figure 7:
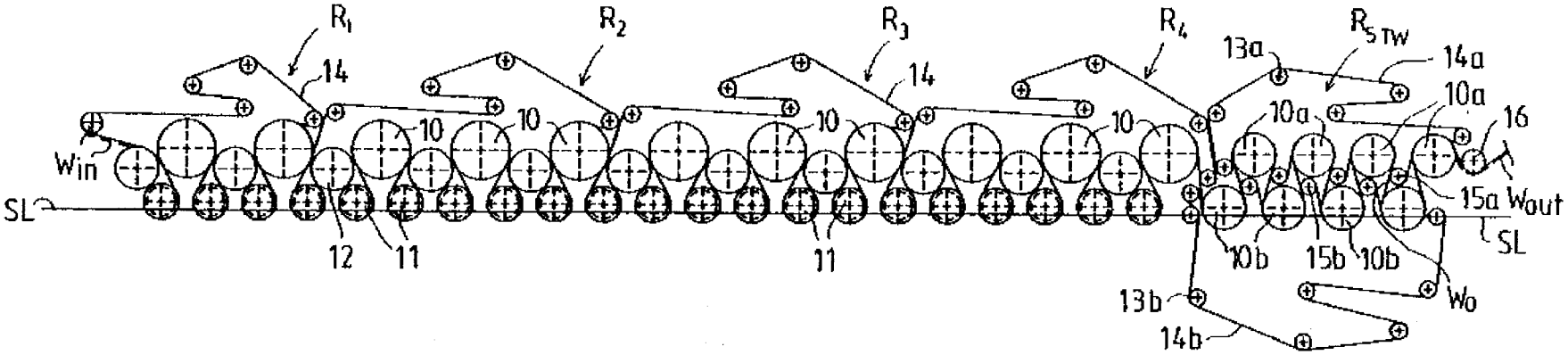
FIG. 7 is an illustration similar to FIGS. 5 and 6 of a dryer section in which, in the initial end and over most of the length of the dryer section, there are normal (not inverted) drying groups in accordance with the invention and in which the last group is a group with twin-wire draw.

FIG. 7 shows a dryer section that is in the other respects similar to FIG. 5, except that the last group is a twin-wire group $R_{5TW}$. In this group $R_{5TW}$, in a manner in itself known, there are two rows of contact-drying cylinders 10*a* and 10*b* and reversing rolls 15*a*, 15*b* in the gaps between the cylinders. The twin-wire group $R_{5TW}$ includes an upper wire 14a which is guided by leading rolls 13*a* and reversing rolls 15*a* as well as by the upper cylinders 10*a*, and a lower wire 14*b* which is arranged in a similar way and is guided by leading rolls 13*b* and reversing rolls 15*b* as well as by the lower cylinders 10*b*. Between the rows of cylinders 10*a* and 10*b*, the web W has free draws $W_o$. As an alternative, it is possible to use such a positioning of the leading rolls 15*a*, 15*b* that the free draws $W_o$ can be made shorter or even entirely closed. The free draws $W_o$ provide the advantage that in their areas the web has a possibility to relax from drying strains.

Figure 8:
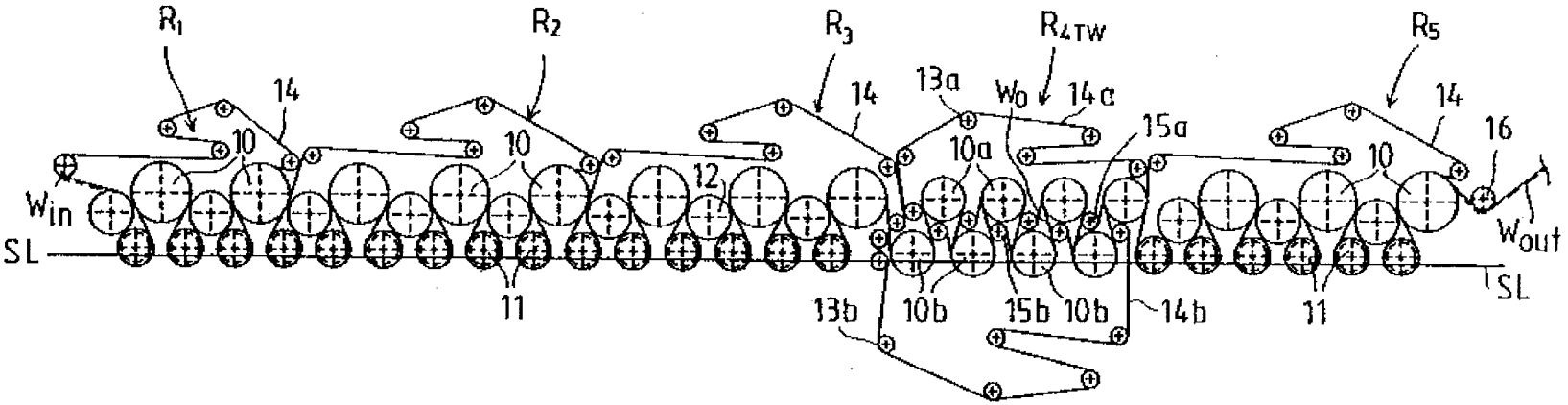
FIG. 8 shows a variation of the invention in which there are initially three normal (not inverted) drying groups in accordance with the invention and after that one group with twin-wire draw and finally one non-inverted group with single-wire draw in accordance with the invention.

FIG. 8 differs from FIG. 7 in the respect that the twin-wire group $R_{4TW}$ is placed as the second-to-last or penultimate group in the dryer section, and the last group $R_5$ is a normal (not inverted) single-wire group in accordance with the invention. The particular advantages of this location of the group with twin-wire draw $R_{4TW}$ come out from the assignee's Finnish Patent Application No. 940749 (filed Feb. 17, 1994) and corresponding to U.S. patent application Ser. No. 08/389,952.

The dryer section in accordance with the invention is comprised of a number of successive groups $R_1, \ldots, R_N$ with single-wire draw, of which several, preferably most of them, with the exception of one group $R_{5TW}$, $R4_{TW}$ with twin-wire draw, are compact groups in accordance with the invention. Depending on the requirement of capacity of the dryer section, the number N of the groups $R_1, \ldots, R_N$ is typically selected within the range of N=3 to 8, preferably N=4 to 6.

In the dryer sections shown in FIGS. 5–8, it is possible to apply so-called ropeless tail threading over their entire length. In such a case, as the reversing cylinders 11, it is necessary to use cylinders subjected to a vacuum, so that the tail end can be made to adhere to the drying wire 14 on the turning sector of the reversing cylinders 11 by the effect of the negative pressure. In ropeless tail threading, it is additionally possible to employ various blower means in themselves known, by whose means the tail threading is ensured at problematic points, such as group gaps or equivalent.

The examples provided above are not meant to be exclusive. Many other variations of the present invention would be obvious to those skilled in the art, and are contemplated to be within the scope of the appended claims.

I claim:

1. In a single drying group with single-wire draw in the dryer section of a paper machine, including heated drying cylinders having a smooth face against which a paper web to be dried is brought into direct contact, a reversing cylinder arranged between each adjacent pair of said drying cylinders, a drying wire for supporting the web, guide rolls for guiding said drying wire in a loop such that said drying cylinders are situated outside said wire loop and said reversing cylinders are situated in said wire loop, the improvement comprising said drying cylinders comprising a plurality of small-diameter cylinders and a plurality of large-diameter cylinders larger than said small-diameter cylinders arranged in an alternating arrangement, each of said small-diameter cylinders being arranged such that centers of rotation of said small-diameter cylinders are situated at a first level different than a second level at which centers of rotation of said large-diameter cylinders are situated, and said reversing cylinders being situated relative to said drying cylinders to provide runs for said drying wire and the web supported thereon from each of said large-diameter cylinders to one of said small-diameter cylinders over a respective one of said reversing cylinders and from each of said small-diameter cylinders to one of said large-diameter cylinders over a respective one of said reversing cylinders, each of said reversing cylinders having a center of rotation situated at a third level different than said first and second levels.

2. The wire group of claim 1, wherein the distance between each of said small-diameter cylinders, said large-diameter cylinders and said reversing cylinders and a successively arranged one of said small-diameter cylinders, said large-diameter cylinders or said reversing cylinders is approximately one-half of the sum of the diameter of said large-diameter cylinders and the diameter of said small-diameter cylinders.

3. The wire group of claim 1, wherein said group constitutes a normal wire group open downward in which said second level at which said large-diameter cylinders are situated is above said first level at which said small-diameter cylinders are situated and said third level at which said reversing cylinders are situated, said small-diameter cylinders being situated intermediate of said large-diameter cylinders and said reversing cylinders.

4. The wire group of claim 3, wherein said first, second and third levels are horizontal levels.

5. The wire group of claim 1, wherein said group constitutes an inverted wire group in which said third level at which said reversing cylinders are situated is above said first level at which said small-diameter cylinders are situated and said second level at which said large-diameter cylinders are situated, said small-diameter cylinders being situated intermediate of said large-diameter cylinders and said reversing cylinders.

6. The wire group of claim 1, wherein said large-diameter cylinders are arranged such that said second level on which the centers of rotation of said large-diameter cylinders are situated is substantially horizontal, said small-diameter cylinders are arranged such that said first level on which the centers of rotation of said small-diameter cylinders are situated is substantially horizontal, and said reversing cylinders are arranged such that said third level on which the centers of rotation of said reversing cylinders are situated is substantially horizontal.

7. The wire group of claim 1, wherein the ratio of the diameter of said large-diameter cylinders to the diameter of said reversing cylinders is from about 1.4 to about 3.5, the ratio of the diameter of said small-diameter cylinders to the diameter of said reversing cylinders is from about 1.2 to about 3.0.

8. The wire group of claim 1, wherein the ratio of the distance in a machine direction between a first one of said reversing cylinders arranged before one of said small-diameter cylinders and a second one of said reversing cylinders arranged after said one of said small-diameter cylinders to the distance in the machine direction between one of said large-diameter drying cylinders and an adjacent one of said small-diameter drying cylinders is from about 1.0 to about 1.5, the ratio of the distance in the machine direction between a pair of said reversing cylinders arranged before and after one of said large-diameter cylinders to the distance in the machine direction between said adjacent drying cylinders is from about 0.7 to about 1.0, the ratio of the difference in height between said first and third levels to the distance in the machine direction between said adjacent drying cyclinders is from about 0.4 to about 0.8, and the ratio of the difference in height between said second and third levels to the distance in the machine direction between said adjacent drying cylinders is from about 0.7 to about 1.1.

9. The wire group of claim 1, wherein the diameter of said large-diameter cylinders is from about 1800 mm to about 2600 mm, the diameter of said small-diameter cylinders is from about 1500 mm to about 2000 mm, and the diameter of said reversing cylinders is from about 600 mm to about 1800 mm.

10. The wire group of claim 1, wherein the diameter of said large-diameter cylinders is from about 2200 mm to about 2500 mm, the diameter of said small-diameter cylinders is from about 1800 mm to about 1900 mm, and the diameter of said reversing cylinders is from about 1200 mm to about 1500 mm.

11. The wire group of claim 1, wherein said drying wire is arranged to press the web against said large-diameter cylinders over a circumferential portion thereof having a magnitude of from about 220° to about 280°, and said drying wire is arranged to press the web against said small-diameter cylinders over a circumferential portion thereof having a magnitude of from about 200° to about 260°.

12. The wire group of claim 1, wherein said drying wire is arranged to press the web against said large-diameter cylinders over a circumferential portion thereof having a magnitude of from about 235° to about 265°, and said drying wire is arranged to press the web against said small-diameter cylinders over a circumferential portion thereof having a magnitude of from about 210° to about 250°.

13. The wire group of claim 1, wherein the distance between one of said large-diameter drying cylinders and an adjacent one of said small-diameter drying cylinder is substantially equal to the distance between adjacent pairs of said reversing cylinders and is in the range of from about 1800 mm to about 2400 mm.

14. The wire group of claim 1, wherein the distance between one of said large-diameter drying cylinders and an adjacent one of said small diameter drying cylinder is substantially equal to the distance between adjacent pairs of said reversing cylinders and is in the range of from about 2000 mm to about 2200 mm.

15. A dryer section of a paper machine comprising a plurality of the wire groups of claim 1, substantially all of the plurality of wire groups constituting normal wire groups in which said second level at which said large-diameter cylinders are situated is above said first level at which said small-diameter cylinders are situated and said third level at which said reversing cylinders are situated, said small-diameter cylinders being situated intermediate of said large-diameter cylinders and said reversing cylinders, the web having a closed draw in substantially all of group gaps defined between adjacent pairs of said plurality of wire groups.

16. The dryer section of claim 15, wherein all of said plurality of wire groups open downward such that broke removal by the force of gravity is applied over the entire length of the dryer section.

17. The dryer section of claim 15, wherein at least one of said wire groups is an inverted wire group in which said third level at which said reversing cylinders are situated is above said first level at which said small-diameter cylinders are situated and said second level at which said large-diameter cylinders are situated, said small-diameter cylinders being situated intermediate of said large-diameter cylinders and said reversing cylinders.

18. The dryer section of claim 17, wherein said at least one inverted group is arranged as the penultimate wire group in the dryer section and one of said normal wire groups is arranged after said at least one inverted group.

19. The dryer section of claim 10, further comprising as the last or penultimate wire group in the dryer section a group provided with twin-wire draw including drying cylinders arranged in two rows and in which the web has open draws in gaps between said two rows of drying cylinders.

20. A method for reducing the length of a drying section of a paper machine, comprising the steps of arranging a plurality of small-diameter drying cylinders at a first height level, arranging a plurality of large-diameter drying cylinders larger than said small-diameter cylinders at a second height level different than said second level, said small-diameter cylinders being arranged in gaps between each adjacent pair of said large-diameter cylinders and in an alternating arrangement with said large-diameter cylinders, arranging reversing cylinders at a third height level different than said first and second levels, and supporting a web on a drying wire and passing the wire supporting the web thereon from each of said large-diameter cylinders to one of said small-diameter cylinders over a respective one of said reversing cylinders and from each of said small-diameter cylinders to one of said large-diameter cylinders over respective one of said reversing cylinders.

21. The method of claim 20, further comprising the steps of arranging said large-diameter cylinders above said small-diameter cylinders, and arranging said small-diameter cylinders above said reversing cylinders.

22. The method of claim 20, further comprising the steps of arranging said small-diameter cylinders above said large-diameter cylinders, and arranging said reversing cylinders above said small-diameter cylinders.

23. The wire group of claim 1, wherein each of said small-diameter cylinders, said large-diameter cylinders and said reversing cylinders is spaced from a successively arranged one of said small-diameter cylinders, said large-diameter cylinders or said reversing cylinders a distance which is less than the diameter of said large-diameter cylinder.

* * * * *